US006488042B2

(12) United States Patent
Troyer

(10) Patent No.: US 6,488,042 B2
(45) Date of Patent: Dec. 3, 2002

(54) WALKING CANE HAVING A MULTIFUNCTIONAL, EXPANDABLE HANDLE

(76) Inventor: Devin J. Troyer, 200 Duck Pond Rd., Columbia, SC (US) 29223

( * ) Notice: Subject to any disclaimer, the term of this patent is extended or adjusted under 35 U.S.C. 154(b) by 15 days.

(21) Appl. No.: 09/810,675

(22) Filed: Mar. 19, 2001

(65) Prior Publication Data

US 2002/0129844 A1 Sep. 19, 2002

Related U.S. Application Data

(60) Provisional application No. 60/258,597, filed on Dec. 29, 2000.

(51) Int. Cl.[7] ..... A45B 9/02

(52) U.S. Cl. ..... 135/65; 135/71; 135/80; 135/77; 135/66; 248/155.1

(58) Field of Search ..... 135/65, 66, 71, 135/72, 77, 79, 80, 84; 248/155, 155.1, 155.3

(56) References Cited

U.S. PATENT DOCUMENTS

| | | | | | |
|---|---|---|---|---|---|
| 731,437 | A | * | 6/1903 | Czermak et al. | 135/66 |
| 2,346,038 | A | | 4/1944 | Mason | |
| 3,392,946 | A | * | 7/1968 | Stromberg | 135/83 |
| 4,121,605 | A | * | 10/1978 | Schmerl | 135/65 |
| 4,997,001 | A | | 3/1991 | DiCarlo | |
| 5,755,245 | A | | 5/1998 | Helvoort | |
| 5,871,025 | A | | 2/1999 | Richter | |

FOREIGN PATENT DOCUMENTS

| | | | | |
|---|---|---|---|---|
| DE | 364544 | * | 11/1922 | 135/66 |
| FR | 797836 | * | 5/1936 | 135/66 |
| IT | 493138 | * | 4/1954 | 135/66 |

* cited by examiner

*Primary Examiner*—Lanna Mai
*Assistant Examiner*—Winnie Yip
(74) *Attorney, Agent, or Firm*—F. Rhett Brockington

(57) ABSTRACT

A walking cane having a multifunctional handle, where the handle, which outwardly appears to be a conventional handle, is comprised of articulating elements which can be rotated outwardly, therein transforming the handle into a tripod like structure. The cane then becomes self-standing when inverted. Magnets are used to hold the articulating elements in position in the unified form, and the proximity of these magnets may have some therapeutic value.

6 Claims, 4 Drawing Sheets

WALKING CANE HAVING A MULTIFUNCTIONAL, EXPANDABLE HANDLE

The invention claims the priority filing date of Dec. 29, 2000, which is the filing date of the predecessor provisional patent application entitled "Walking Cane Having a Multifunctional, Expandable Handle", bearing serial No. 60/258597 and pending before the United States the Patent and Trademark Office.

The invention relates generally to walking canes, and more particularly to walking canes having a handle that has articulating elements.

BACKGROUND

Walking canes, also know as walking sticks, have a colorful history of being modified to secretly house guns and switchblades. In addition to these romantic adaptations there have been a number of practical improvements. One such example is Mason's "Pickup Cane", disclosed in U.S. Pat. No. 2,346,038, which is a walking cane that has an articulating "finger" at the tip of the cane. The "finger", which is normally recessed in the shaft, can be actuated using a trigger in the handle to grasp items at the tip of cane, therein eliminating the need for the user to have to bend or stoop down. Another example of a walking cane having a practical improvement is disclosed by Van Helvoort in U.S. Pat. No. 5,755,245. Van Helvoort's invention is a cane that can be made self-standing. The shaft of the cane has small legs near the tip that can be sprung outward by depressing a button near the base of the handle. The button unlocks a spring loaded two piece shaft causing the shaft to telescope, and on telescoping the legs rotate outward. To reposition the legs back in the shaft, the cane has to be reloaded by compressing the shaft together, and this action causes the legs to rotate upward back into a recess in the shaft.

An improved invention would be a self-standing cane that didn't elongate when the supporting elements are deployed, and that could not automatically deploy if a button is accidentally pushed. While the concept of a button is appealing, the practical advantages of automatic deployment of the supporting legs, when weighed against the frequency of the need to do so and the difficulty of retrieving the legs, for most people probably does not offset the conveniences especially in light of a heightened accidental risk associated with an unplanned deployment. Another consideration is the safety of the deployed legs. Ideally, the legs should be blunt in the event that someone inadvertently fell on to the cane. Additionally, pointed legs will tend to puncture a surface rather than be supported by it, so that sharp legs would tend to penetrate an earthen surface. A third consideration is the weight and styling of the walking cane. If the walking cane is too heavy to be easily carried, then people will quickly give it up. An example of a very stable, heavy, multi-legged cane is illustrated by DiCarlo's invention, U.S. Pat. No. 4,997,001. A self-standing walking cane that is conventional in appearance and relatively light weight is desired. Furthermore, a preferred cane would be one that is not only a walking aid and self-standing, but also a cane that has ergonomic features. Specifically, ergonomic features would include a handle that is easy to grip and a grip that could have potential health benefits to the user's hand. A walking cane having recreational utility would also be a valuable feature. By way of illustration, Richter discloses his invention in U.S. Pat. No. 5,871,025, where Richter's cane converts to a portable chair. These chairs/canes are often carried to golf tournaments.

DESCRIPTION OF THE INVENTION

The Invention is a walking cane having a multifunctional handle. The handle is comprised of a base and a pair of articulating elements, a right element and a left element, where the elements are hingedly connected to the base. The elements can be articulated as a pair or separately, having an angular motion that is substantially opposite in rotation, and radial from a centerline of the base. On a bottom face of the base, the base is fitted with a reducing connector which rigidly attaches the base to a longitudinal perpendicular member. The longitudinal member is a shaft of the walking cane, and it is normally a straight section. The handle, having a shape which could be generally described as an ellipsoidal cylinder, is sized and optimized in curvature so as to easily fit a hand. The handle is functionally, and by all cursory appearances solid in form, when the handle is in the unified, collapsed form. The base and the pair of articulating elements are derivative subsections of the handle. The right element is generally an elongated polyhedron having a curved-side and two straight sides that intersect at a right angle; where the straight sides form close fitting interior walls that are in contact with opposing walls of the base. The ends of the polyhedron are complex, with the anterior end being rounded and suitable for angular rotation, and the posterior end being blunt with an interior indentation suitable for as a pry point. The polyhedron is sectioned out of the handle lengthwise. The left element is the mirror image of the right element. The base is a larger, remaining section. The anterior end of the right element is hingedly connected to the base by an axial pin that projects upward from a right shelf of the base, where the pin is coaxial to the axis of the shaft, and the pin is near the anterior end of the right shelf. The pin is centered and slightly offset from the anterior end of the shelf, said arrangement of right shelf, right pin and right element enabling the right element to pivot off the shelf. The left element is connected similarly to an opposing, left pin. Viewed from the top, the right element can rotate counterclockwise in a plane that is parallel to the bottom face of the right shelf of the base. The arc swept by the rotation is approximately 120 degrees. Rotation is constrained where the right element abuts the anterior end of the right shelf. Visually, the motion of the right element is not dissimilar from the motion of a flapping right wing of a bird. The left element pivots clockwise in an opposing fashion. The right shelf and the left shelf of the base are separated by a spine that runs longitudinally down the centerline of the base. At the posterior end of the right element, embedded in the face of the interior straight side of the right element, is a right magnet. Opposing the right magnet, located in a posterior portion of the spine of the base, is a magnetic component. The magnetic component is preferably a magnet of opposing polarity or a magnetizable metal. The left element is configured similarly. The close proximity of the magnets to the hand could have some therapeutic value.

The instant invention serves as a normal walking cane with the handle in the unexpanded mode. There are three expanded modes. In the fully expanded mode the pair of elements are articulated outward, angularly, and the handle transforms into a tripod. The cane can then be inverted and it will stand upright on its on.

In the partially expanded mode, only one of the elements is articulated, and the cane be laid on its side. The partially expanded mode has the advantage that only a minimum portion of the handle will come in contact with the ground. If the ground is wet the handle stays dry.

In the unexpanded mode, or unified mode, the handle provides a sturdy, ergonomic grip; and an excellent walking cane.

It is anticipated that the invention, particularly in the partially expanded mode, could be used as a dry resting area to keep other gripped devices, such as umbrellas and golf clubs, off the ground. A dry resting area is particularly useful when one is laying down a putter while hitting a wedge just off the green.

DETAILED DESCRIPTION OF THE INVENTION

Figure 1:
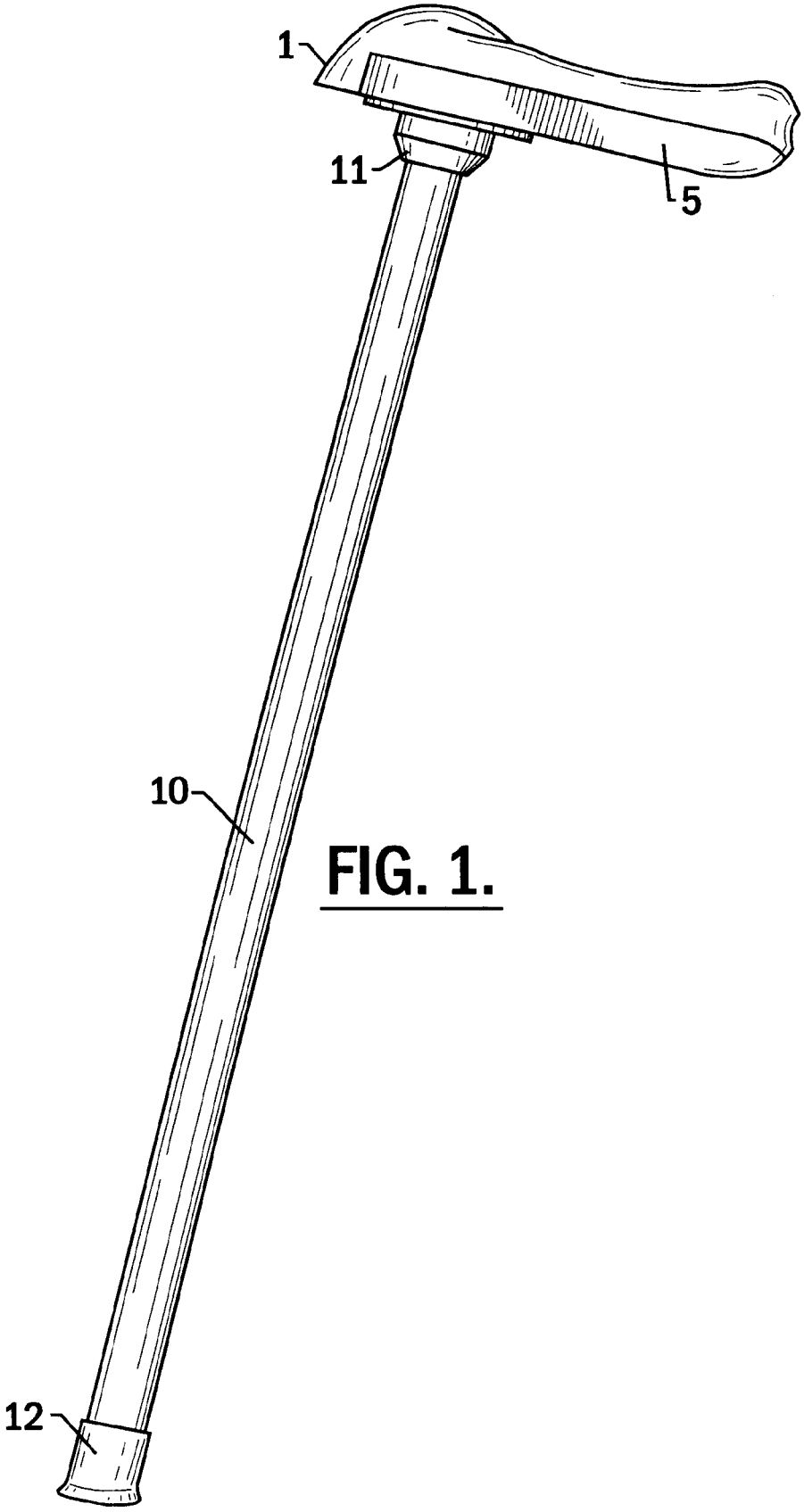
FIG. 1 is a perspective view of the invention, as it would be used as a walking cane.
Figure 2:
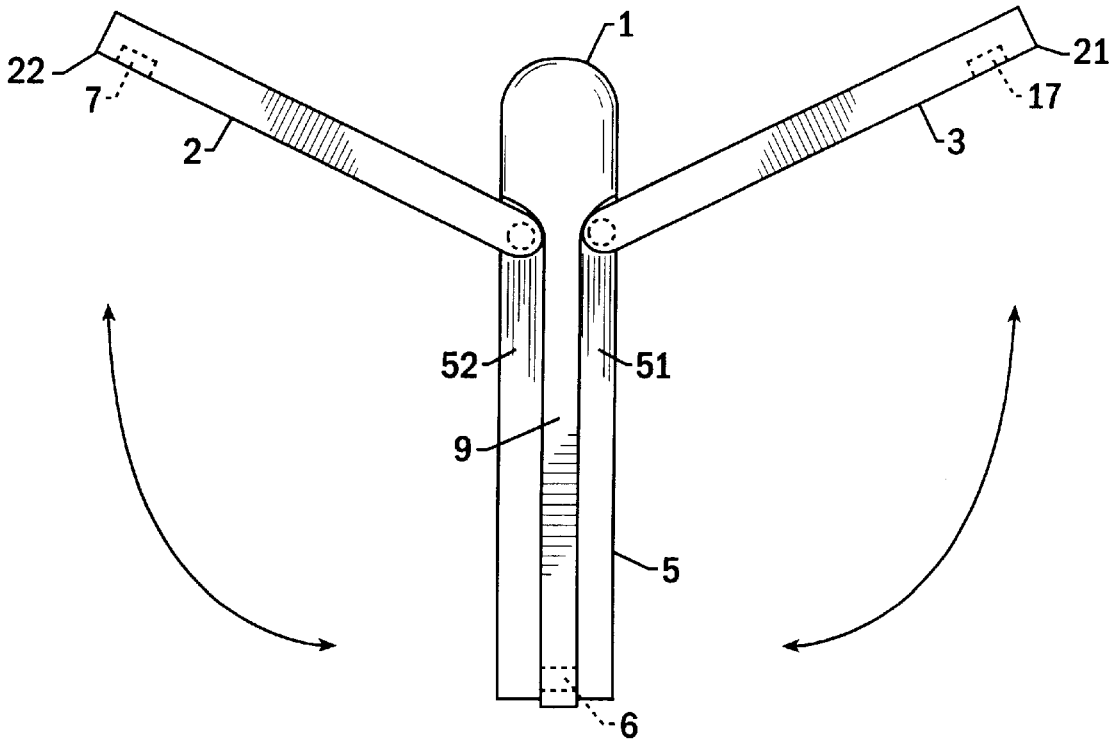
FIG. 2 Is an overhead planar view of the handle with the elements articulated outward.
Figure 3:
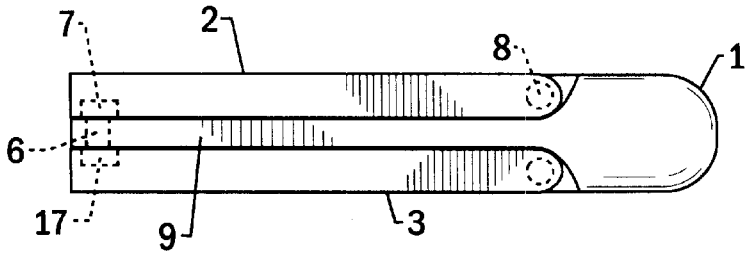
FIG. 3 is an overhead planar view of the handle with the elements inboard and fastened.
Figure 4:
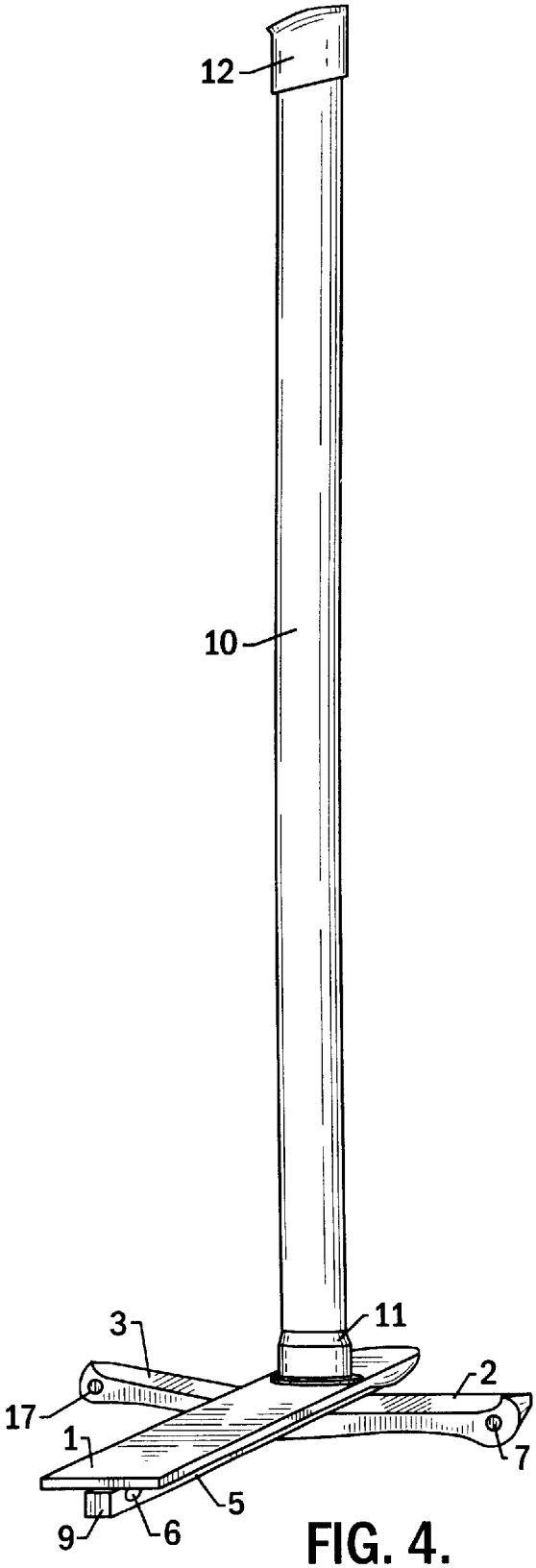
FIG. 4 is a perspective view of the invention inverted, with the elements deployed.
Figure 5:
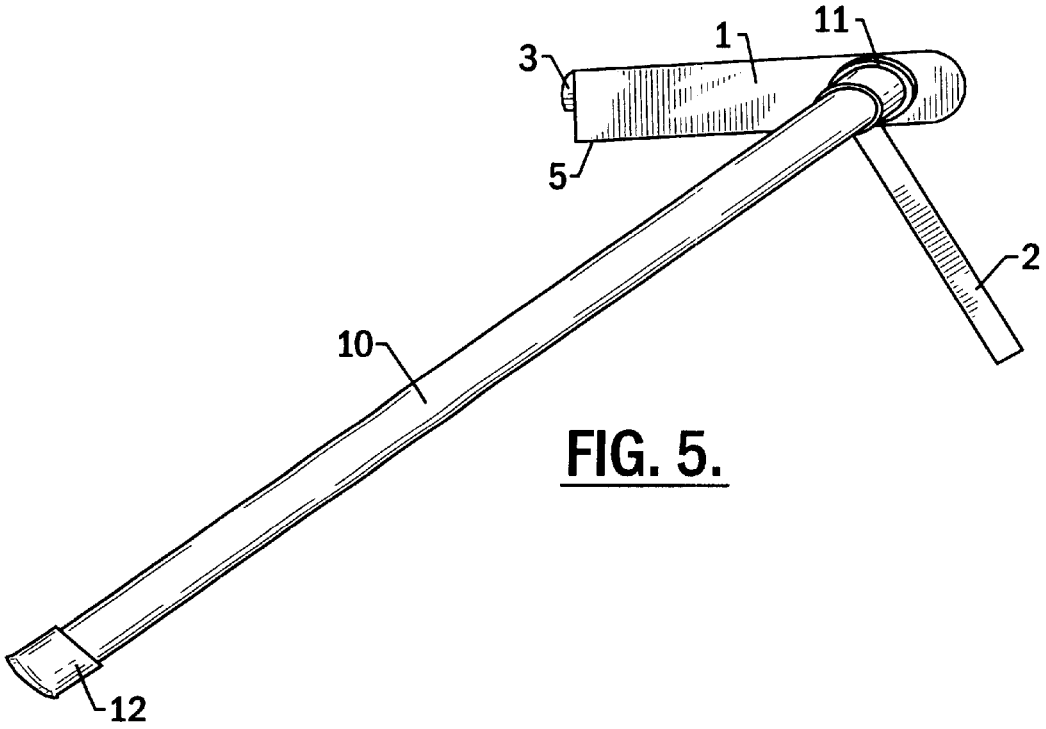
FIG. 5 is a perspective view of the invention on its side, with only one of the elements deployed.

The walking cane in FIG. 1 is comprising of a handle 1, a reducing connector 11, a longitudinal perpendicular member 10, which is the straight portion of a walking cane, and a rubber tip 12 for reducing slippage. FIG. 3 is an overhead planar view of the handle 1. The right element 3 and the left element 2 are folded in. The left pin 8 is shown in ghost. The left magnet 7 and the right magnet 17 are also shown in ghost mounted respectively in the interior face of the left element 2 and the right element 3. The element magnets are in virtual contact with the magnetic component 6, which is a magnet located in the spine 9 of the base 5. The magnets keep the elements fasten to the spine 9 of the base 5; the combination forming a unified functional handle for the walking cane. Additionally, the magnets are in close proximity to where the heel of a hand nominally rests, and could provide some therapeutic value. FIG. 2 is a planar view of the handle 1, wherein the left element 2 and the right element 3 have been rotated approximately 120 degrees away from the base 5. The handle 1 now looks and functions as a tripod. Visible in FIG. 2 is a finger lift 21 on the interior bottom edge of the right element 3. The finger lift 21 allows a user to pry his finger between the spine 9 and the right element 3, with sufficient force to over come the magnetic attraction between magnet 17 and magnet component 6. The left element 2 is opened in a similar fashion. The rotation is limited by the length of shelf 51, where the right element 3 comes into contact with end of shelf 51. The left element 2 has a similar configuration. The articulated handle 1 is now in the fully expanded mode, and the walking cane, inverted as shown in FIG. 4, is self-standing when inverted. FIG. 5 is a perspective view of the invention in the partially expanded mode, and the invention is angled, rather than being perpendicular. Only the left element 2, has been deployed. In the partially expanded mode the cane is not totally self-standing, however only the most distal points of the handle 1 are in contact with the surface, and if the ground were wet the handle 1 would remain dry in the partially deployed mode. The edge of the base 5 and the left element 2 keep the longitudinal member 10 angled off the surface.

I claim:

1. A walking cane having a multifunctional handle, where the handle functions in a unified mode as a sturdy, ergonomic grip for the walking cane, and alternatively the handle functions in an expanded mode, as an assembly that enables the cane to be self-standing when inverted; where said handle in the unified mode is sized and optimized in curvature so as to comfortably fit a user's hand, where said handler is comprised of close fitting subsections consisting of a base, a left element, and a right element, where said left element and right element are a pair of articulating elements; where said base and said pair of articulating elements have opposing magnets positioned so as to reversibly fasten the subsections into a unified assembly; where the right element and the left element are hingedly connected on opposing sides of a spine that longitudinally bisects the base, and where the right element and the left element can individually rotate away from a centerline of the base.

2. A walking cane as claimed in claim 1 where the right element and a left element are substantially mirror images, and where the right element is generally an elongated polyhedron having a curved-side, a bottom side and a left vertical side, where the left vertical side fits flush against a right wall of the spine of the base, and the bottom side is nearly flush against a upper portion of the base, where the upper portion of the base is a right shelf.

3. A walking cane as claimed in claim 2 where the right element has a ridge cut out of a distal end of the element, where said ridge is a finger lift for pulling the element away from the spine of the base.

4. A walking cane as claimed in claim 1 where the base of the handle has a bottom face of the base, where said bottom face is fitted with a reducing connector which rigidly attaches the base to a longitudinal perpendicular member.

5. A walking cane as claimed in claim 1 where said handle in the unified mode has an outward physical appearance of being a solid structure.

6. A walking cane as claimed in claim 2 where the left element and the right element have a ridge on a distal end of the elongated polyhedron, where said ridge is a finger lift to pry the element away from the spine so as to release the magnetic fastening.

* * * * *